US008607534B2

(12) United States Patent
Muehlemann et al.

(10) Patent No.: US 8,607,534 B2
(45) Date of Patent: Dec. 17, 2013

(54) METHOD FOR FILLING A PLASTIC CONTAINER HAVING A CONTAINER NECK AND APPLYING A CAPSULE THEREON

(75) Inventors: Rolf Muehlemann, Schlattingen (CH); Daniel Teicher, Immensee (CH); René Epp, Alpnach-Dorf (CH)

(73) Assignee: RM Beteiligungs AG, Stein am Rhein (CH)

( * ) Notice: Subject to any disclaimer, the term of this patent is extended or adjusted under 35 U.S.C. 154(b) by 415 days.

(21) Appl. No.: 12/736,132

(22) PCT Filed: Mar. 12, 2009

(86) PCT No.: PCT/CH2009/000091

§ 371 (c)(1), (2), (4) Date: Nov. 23, 2010

(87) PCT Pub. No.: WO2009/111901

PCT Pub. Date: Sep. 17, 2009

(65) Prior Publication Data

US 2011/0061761 A1 Mar. 17, 2011

(30) Foreign Application Priority Data

Mar. 14, 2008 (CH) ..... 0381/08

(51) Int. Cl.
*B65B 61/00* (2006.01)

(52) U.S. Cl.
USPC ..... 53/420; 53/424; 53/560

(58) Field of Classification Search
USPC ..... 53/420, 452, 423, 424, 133.8, 128.1, 53/560
See application file for complete search history.

(56) References Cited

U.S. PATENT DOCUMENTS

| | | | | |
|---|---|---|---|---|
| 3,305,368 | A * | 2/1967 | Bourelle | 426/120 |
| 3,685,686 | A * | 8/1972 | Raidl | 220/89.3 |
| 3,834,580 | A * | 9/1974 | Ludwig et al. | 220/89.2 |
| 4,211,334 | A * | 7/1980 | Witten et al. | 220/89.3 |

(Continued)

FOREIGN PATENT DOCUMENTS

| | | |
|---|---|---|
| GB | 891341 | 3/1962 |
| WO | WO 2006/056082 A1 | 6/2006 |

OTHER PUBLICATIONS

U.S. Appl. No. 10/566,528, filed Jan. 30, 2006; inventor Rolf Muehlemann; title Plastic Drinks Bottle With Cap (Abandoned).

(Continued)

*Primary Examiner* — Sameh H. Tawfik
(74) *Attorney, Agent, or Firm* — Pauley Petersen & Erickson

(57) ABSTRACT

The invention relates to a method for applying capsules (1) to a plastic container (54) which is aseptically filled with a liquid and which is weld-sealed with a membrane (80). The capsule (1) to be applied, which preferably is constituted of two aluminum foils (2, 6) having a collar (58), is placed on the membrane (80) with a planar surface thereof and the collar is mechanically bent so that it is reliably secured to the container neck (50). The cap (100) is then pressed onto it so that the collar (58) is retained between the container neck (50) and the cap (100) in a form-and in a force-locking connection. The method according to the invention avoids the risk of the capsule being destroyed, which can happen during welding, and the risk of soiling, which can happen during gluing.

14 Claims, 2 Drawing Sheets

(56) References Cited

U.S. PATENT DOCUMENTS

| | | | | |
|---|---|---|---|---|
| 5,370,222 | A * | 12/1994 | Steigerwald et al. | 206/222 |
| 5,503,282 | A * | 4/1996 | Montgomery | 215/252 |
| 5,927,549 | A * | 7/1999 | Wood | 222/83 |
| 6,823,649 | B1 | 11/2004 | Pauchet | |
| 7,828,141 | B2 * | 11/2010 | Epp et al. | 206/222 |
| 2008/0006599 | A1 | 1/2008 | Muhlemann | |
| 2009/0272712 | A1 | 11/2009 | Muhlemann | |

OTHER PUBLICATIONS

Notification of Transmittal of Translation of the International Preliminary Report on Patentability, Form PCT/IB/338 (1 page), dated 2010.

Translation of the Written Opinion of the International Searching Authority, Form PCT/IB/373 (5 pages), dated 2010.

* cited by examiner

FIG. 1
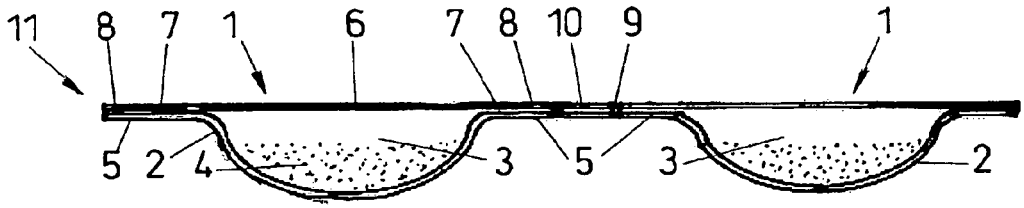
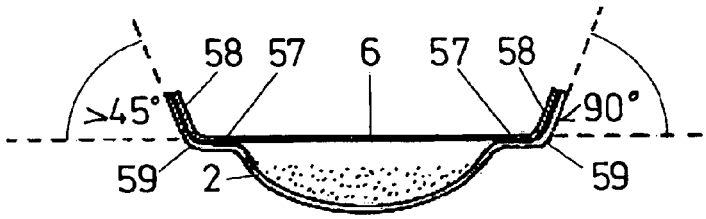
FIG. 2
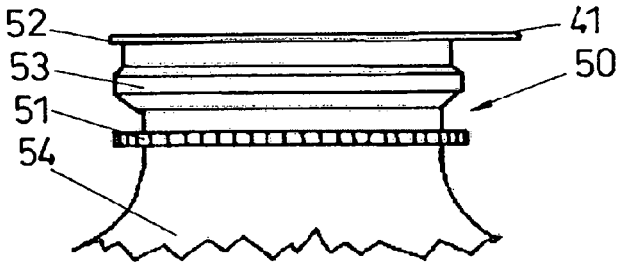
FIG. 3
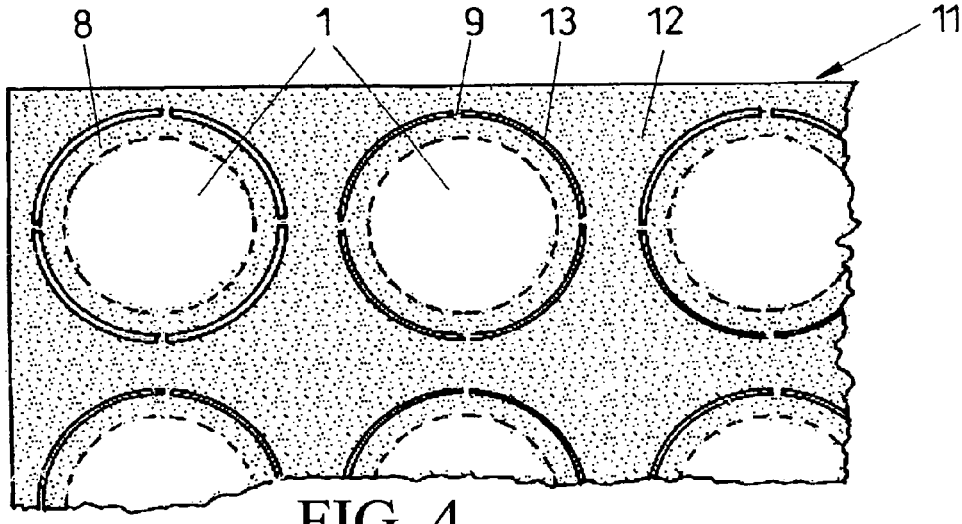
FIG. 4

METHOD FOR FILLING A PLASTIC CONTAINER HAVING A CONTAINER NECK AND APPLYING A CAPSULE THEREON

BACKGROUND OF THE INVENTION

1. Field of the Invention

This invention relates to a method for filling a plastic container having a neck, and to the attachment of a capsule thereon, in a bottling installation, wherein the capsule is of plastic deformable material, with substances enclosed therein in a solid, liquid or pourable condition, which are to be dispensed into the plastic container. First, the plastic container is filled in an aseptic manner and afterwards the container neck is sealed with a membrane, whereupon the capsule is attached onto the membrane, and a cap or closure is placed over the capsule onto the container neck. The capsule is manufactured of two aluminium films which are welded to one another, wherein the lower film forms a deep drawn receiver space, and the upper, covering aluminium film is planar, so that both films together have a planar edge around the receiver space.

2. Discussion of Related Art

Containers, in which a substance is located, to which further substances must be added before consumption, are increasingly offered on the market. This concept has one advantage that the substances which must finally be added into the fluid and which to some extent are light-sensitive, are also supplied on the container, packaged in capsules, so that the substances which are to be dispensed into the fluid located in the container, are not applied into the fluid until the user applies them. This system has been provided successfully today for the most varied of dairy mixing products, pharmaceutical preparations, vitamin-enriched drinks, and the like.

The capsules, which are used with this, are present in different forms on the market and are also manufactured in different manners. For example, a method for manufacturing capsules, as may be applied here, is known from U.S. Pat. No. 6,823,649. With these capsules, two aluminium films are added over one another, the lower film deep drawn, so that a receiver space forms, in which the substance to be dispensed is filled, in a liquid, solid or free-flowing condition. The second aluminium film is welded thereover. This film thus remains absolutely planar. The two films which are to be connected to one another are supplied in rolls, and the capsules are thus manufactured in a coherent manner as endless strips. These endless strips may then be cut in arcs, or the capsules may be pushed directly out of these strips.

In many cases of application, the fluid filled into the container must be aseptically filled and subsequently sealed directly by way of a membrane. With different methods used today, the capsules are inserted into the caps or closures by suitable handling machines and these closures are charged with the capsules delivered to the bottler. This is extremely problematic, since this is not in accordance with the logistics. In principle, the capsules in the plastics-processing companies must be inserted directly in the vicinity of the injection molding machines, since otherwise the extremely complex closures must be individualized again in special, very expensive handling machines, aligned and thereafter the capsules inserted and secured therein. The plastics-processing companies are usually not equipped for this purpose. Added to this is the fact that with this method, there exists the danger that the capsules become leaky and at the point in time at which the closure gets onto the filled containers, the contents of the capsules have already experienced a quality reduction or even a complete decomposition. This problem has been recognized and accordingly a method developed, as is known from PCT International Publication WO 2006/056082. With this method, two possibilities are offered, specifically in the case with which the capsule formation is effected directly on the bottle neck. With the second solution, which is of particular interest here, the capsule is placed onto the first membrane and there connected. It has been suggested to weld the capsule onto the already present membrane in the container neck region. This method has been found to be relatively slow, and also has been found to be extremely critical to realize a second welding of the capsule to the membrane over an already present welding between the container neck and the first membrane, without the first welding thereby becoming damaged.

In order to avoid this problem, installations have been changed, so that the capsules are bonded on the first membrane in turn only in the region above the container neck, by way of a foodstuff-allowable adhesive. Although the result was satisfactory, this method too does not permit an increased production speed, and also the adhesive has led to a large dirtying of the bottling installations.

SUMMARY OF THE INVENTION

It is one object of this invention to improve a method of the initially described type, so that the previously mentioned problems are avoided and preferably the production speed increased.

This object is achieved by a method of the initially mentioned type, which in a first step, the edge which is formed together by the two films of the capsule, is bent out of the plane surface by less than 90°, but more than 45°, so that a peripheral collar arises with a diameter of the magnitude of the container neck, on which the capsule is placed so that it is held on the container neck with a positive and/or friction fit, whereupon the cap is stuck on, the cap holding the capsule at least on the container neck in the required position.

Further advantageous forms of the method according to the invention are to be deduced from this specification and the claims.

BRIEF DESCRIPTION OF THE DRAWINGS

The method according to this invention is explained in view of the accompanying drawings and the elements which are applied with the method are shown in various method situations alone, and the method is shown schematically, wherein:

FIG. 1 shows a cross-sectional view of capsules, such as delivered in a bottling company;

FIG. 2 shows a central, vertical section taken through a capsule, after the flanging of the edge;

FIG. 3 shows a lateral view of a part of a container in the region of its neck, with a membrane which has been welded on;

FIG. 4 shows several capsules which are held together in film sheets, in a plan view on the planar surface.

DETAILED DESCRIPTION OF THE INVENTION

Figure 5:
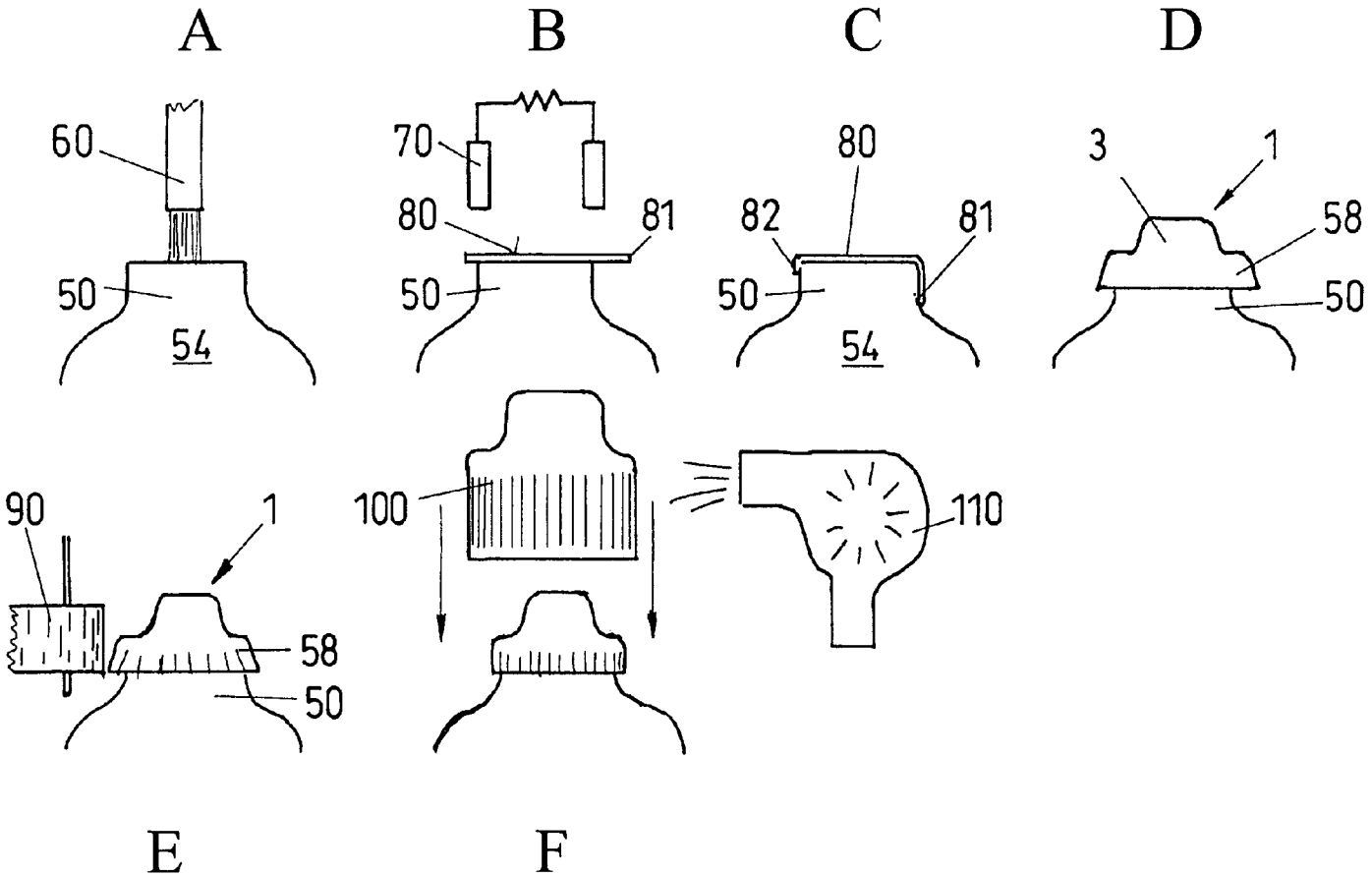
FIG. 5 shows a schematic view that represents the various method steps of the method according to this invention.

The design of the capsules is first discussed for an improved understanding of the method according to this invention. FIG. 1 shows the capsule indicated in its entirety at numeral 1 and comprises a first film 2, in which a recess is formed in a deep drawn or pressed manner, and the recess forms the receiver space 3. The material to be dispensed into the receptacle is introduced into the receiver space 3 and this substance may be solid, liquid or free-flowing or may be of the most varied of substances. In fluid form, this may for example be a highly concentrated active ingredient, for example a washing agent or a pharmaceutical preparation or it may be a tablet, with which the dried substances are pressed together, or it may be powder for example, which is to be dispensed into the container. The substance to be dispensed is indicated at numeral 4. A horizontal edge 5 which is formed from the first film 2 runs around the recess.

A second film 6 lies over the first film 2. The second film 6 is completely planar. The second, planar film 6 covers the receiver space 3. The second, planar film 6 also comprises a horizontal edge 7, which runs above the horizontal edge of the first film. In the region of the horizontal edges 5 and 7, these are connected to one another by an annular sealing 8. Usually, the two films 2 and 6 are provided as strips from large rolls. Accordingly, a multitude of capsules 1 are formed from these strips. In this case, the capsules 1 after welding or during welding are not completely punched out, but break-off location bridges 9 remain. The capsules 1 thus remain firmly connected to the film remains 10. So-called blister sheets 1 arrive at a bottling installation. The blister sheets 11 thus comprise a multitude of capsules 1 with film remains 10 which lie therebetween and which are connected to the capsules 1 via the break-off location bridges. The term blister sheet is correct inasmuch, with regard to the first film 2, because it is an aluminium film coated with plastic. This film is plastically deformable despite the plastic coating which means that the aluminium share is larger than the plastic share deposited thereon. After a deformation of the first film, this thus does not deform back in an elastic manner. The same also applies to the second film 6, which likewise is essentially of aluminium. This too comprises a plastic coating which is suitable for the thermal welding of the second film 6 to the first film 2.

In principle, it is also possible to use the capsules in a completely punched out manner, for the method. The design of blister sheets 11 is preferred because it is ensured up to the introduction of the capsules 1 into the filling procedure, that their edges remains at least approximately planar. If one completely punched out these capsules beforehand and provided them as a protective product, then the edges would certainly be deformed and no longer completely planar. This would compromise the subsequent method. For this reason, one may preferably use the method along with using blister sheets, with which the capsules 1 are still held together.

Such a blister sheet is shown in a partial view in FIG. 4. Preferably, at least the second planar film in the region outside the recesses which form the receiver spaces 3, is provided with a structure. Such structures are present from the state of the art in various forms. These may be grid-like or point-like rastered structures. The structures serve for effecting a controlled tearing of the films. This is particularly useful in the region of or near the break-off location bridges 9. The incorporated structure here is only indicated in an implied manner and indicated at numeral 12. In FIG. 4, one further recognizes the incorporated part punchings 13, between which only the break-off location bridges 9 remain. In each case, the annular sealing or welding 8 runs within the circular space limited by the part punchings. This annular welding or sealing 8 is not interrupted in the region of or near the break-off bridges 9.

In FIG. 3, a container neck 50 is only represented for example in a partial side view. The container 54 thus may only be partly recognized. The container neck 50 is limited to the top by the pour-out edge 52. A support collar 51 is present below the container neck. The support collar 51 serves for holding in a bottle blowing machine. A fastening bead 53 is integrally formed on the container neck 50, between the support collar 51 and the pour-out edge 52, and this fastening bead holds a closure or cap to be fastened thereon. In FIG. 3, one recognizes that a membrane disk 40 is welded on the pour-out edge 52. The membrane disk 40 has an outwardly projecting tear-off tab 41. The membrane disk 40 in diameter is slightly larger than the pour-out edge 52 and as a result projects beyond.

The individual steps of the method according to this invention are explained further by way of FIG. 5. In a first step, which is indicated in FIG. 5 at A, the aseptic filling of the only partly represented container 54 is shown. The container neck 50 is only schematically represented in a simplified manner. The material to be filled in comes from a filling nozzle 60, which is part of a bottling installation. If the container 54 is filled, then a membrane 80 is welded onto the container neck 50 in the next step B. The membrane to be welded on may comprise a plastic film or of a coated aluminium film. The membrane in the form of a disk has a tear-off tab 81. The membrane as a whole has a diameter slightly larger than the receptacle neck 50. Thus, it is ensured that the membrane 80 completely covers the pour-out opening of the container neck 50, and the welding of the membrane 80 onto the container neck 50 is effected in a complete and sealing manner. Thus, a projecting edge 82 remains. The welding of the disk 80 on the container neck 50 is effected by a welding punch 70, which is represented symbolically. The welding or sealing may be effected in a purely thermal manner or also by way of ultrasound. The welding punch 50 may be effected in a suitably designed welding head known per se, which takes the membrane from a supply stack, or punches it simultaneously out of a film, whereupon the membrane held on this welding head under pressure, lies on the container neck 50, and then the actual welding or sealing takes place.

In the next step C, the tear-off tab 81 and the projecting edge 82 are turned over and pressed onto the bottle neck 50. This may for example be effected by a pressing head which may be pushed thereover, or the container 54 is led past or beyond a pressing strip while the container 54 is simultaneously rotated, with which the projecting edge 82 and the tear-off tab 81 are pressed onto the container neck 5. In a subsequent step, which is not shown in FIG. 5, the capsules 1 are taken and the common horizontal edge 5 of the first film 2 and the horizontal edge 7 of the second film, which are connected to one another by welding, are deformed so that an inner horizontal residual edge 57 remains from the annular sealing 8, while the outer edge region is deformed into a bent-up collar 58. This is shown in FIG. 2. The bent-up collar 58 is deformed upwards at less than 90°. Preferably, the inclination of the collar is between 60° and 80°. The kink location 59 between the horizontal inner residual edge 57 and the bent-up collar 58, in diameter, define a measure which at least approximately corresponds to the outer diameter of the bottle neck 50 in the region of or near the pour-out edge 52.

The collar 58, with respect to the receiver space 3, is directed upwards away. The capsule 1, as represented in the successive step D in FIG. 5, may be placed directly onto the bottle neck 50 because of the bent-up collar 58.

With the outwardly directed inclination of the collar 58, the capsule 1 positions itself on the container neck 50 in a centering manner. Thus, a sufficient positive-fit is achieved, which ensures that the capsule 1 does not fall down from the container neck 50 with the further transport. Also, in practise, a certain clamping is achieved by way of the already previously turned over projecting edge 82 of the membrane 80, so that the capsule 1 is not only held on the container neck 50 with a positive fit, but mostly also with a friction fit.

In the subsequent step E, the now bent-up collar 58 of the capsule 1 is fastened on the container neck 50 with an absolutely positive fit by a pressing strip 90. As evident from the already described FIG. 3, the container neck 50 may comprise a fastening bead 53, wherein the bent-up collar 58 is so short that it does not overlap the fastening bead 53. The fastening bead 53 specifically serves for the positive-fit connection between the container 54 or the container neck 50, and the cap or closure 100 to be thereon placed.

The last method step which is represented in FIG. 5, shows the placing of the cap or the closure 100 on the container 54. The cap or the closure 100, as is symbolically represented here, is now pushed or screwed over the capsule 1 onto the container neck 50. Depending on the design of the cap or the closure 100, a mechanical securing of the capsule 1 in its end position is thus effected. The cap or the closure 100 may be designed so that on pressing or screwing the cap or the closure 100 on the container neck 50, simultaneously, the somewhat outwardly projecting bent-up collar 58 is turned over and pressed onto the container neck. In this case, step E may be eliminated. The closure or the cap 100 may be designed so that with the first opening, the capsule 1 is simultaneously deformed or is pierced, so that the contents of the capsule 1, specifically the substance to be dispensed, gets into the container 54. Now, normally one is required to shake the container efficiently, whereupon one then pulls off or screws off the closure or the cap 100, and now one may simply lift the cap 100 which is not bonded, and finally tear away the membrane 80 with the help of the tear-off tab 81, as is usual with such drinks. The closure or the cap may thereafter be used for reclosure.

With packaging of this type, one attempts wherever possible, to always use material in a saving manner. Thus one manufactures the container 54 as thin-walled as possible. Because the method of interest requires a connection which is as exactly fitting as possible, the pressing of the cap or the closure 100 on the container 54 under certain circumstances would lead to the container 54 thereby being deformed, so that its volume is reduced and the fluid contents is pressed upwards and the membrane 80 is destroyed. In order to reduce these forces, it has been found to be advantageous to preheat the closures or caps 100. Because the caps 100 or closures are of plastic, they deform more easily in the warm condition and a thermal expansion simultaneously takes place. The cap or the closure 100 may thus be stuck on with a reduced force by two effects. In FIG. 5, this is shown symbolically by a warm air blower 110 in step F. Because the receptacle 54 is already sealed by the membrane 80 in this position, there is also no danger of a contamination of the contents being able to occur by such a warm air blower.

The already described horizontal residual edge 57 is preferably dimensioned so that this at least has the width which corresponds to the wall thickness of the container neck 50. This, in the case that it is found to be necessary, also permits the realization of a point welding between the capsule 1 and the membrane 80. One would then usefully carry this out directly subsequent to step D.

One would press the capsules 1 out of the blister sheets 11 before carrying out the step D. With the arrangement of the capsules 1 in the blister sheet 11, the capsules may be attached so that these equally correspond to the alignment of the containers 54 in the bottling installation, so that in the bottling installation, the step D, specifically the placing of the capsules 1 and the bending up of the collar 58 with a simultaneous destruction of the break-off location bridges 9 may be effected in one working run. With such a procedure, one would also guide a punch over the respective capsule, by which, as already mentioned, the break-off location bridges are destroyed while simultaneously the respective collar is formed. This is not compelling. It is also possible to punch the capsules 1 out of the sheets in a separated manner and subsequently form the collar 58 by flanging.

Although the membrane 80 is welded or sealed on the container neck 50, preferably in step C, such a connection may also be effected by bonding. For the aseptic packaging however, an absolutely sealing connection between the membrane 80 and the container neck 50 is required and this may be achieved better with little effort by welding technologies.

Because the method steps shown here are conventionally used for other methods and these method steps individually have already been realized in bottling installations, with the exception of the special capsule deformations which are adapted here, one may assume that the method according to this invention may also be carried out without any problem also in bottling installations with high production speeds.

The invention claimed is:

1. A method for filling a plastic container (54) with a neck (50), and an attachment of a capsule (1) thereon, in a bottling installation, wherein the capsule (1) is of a plastic deformable material, with substances enclosed therein in a solid, a liquid or a free-flowing condition, which are to be dispensed into the plastic container (54), the method including the steps of first filling the plastic container (54) in an aseptic manner and then sealing the container neck (50) with a membrane (80), whereupon the capsule (1) is attached onto the membrane (80) and a cap or closure (100) is placed over the capsule (1) onto the container neck (50) and wherein the capsule (1) is manufactured of two aluminium films welded to one another, wherein the lower film (2) forms a receiver space (3) which is deep drawn or pressed, and an upper covering aluminium film (6) is planar, so that both films together have a planar edge around the receiver space (3), in a first step, the edge which is formed together by the two films (2, 6) of the capsule (1), is bent out of the planar surface by less than 90° but by more than 45°, so that a peripheral collar arises with a diameter of a magnitude of the container neck (50), onto which the capsule (1) is placed and held on the container neck (50) with a positive fit and/or a friction fit, the cap (100) is stuck on and holds the capsule (1) at least on the container neck (50) in the required position.

2. A method according to claim 1, wherein the edge is bent up, so that a residual edge (7) flush with the planar film (6) remains, which corresponds approximately to a wall thickness of the container neck (50), and the collar delimits the residual edge to an outside.

3. A method according to claim 1, wherein the capsules (1) are punched from the two film layers (2, 6) only up to break off locations (9) and the capsules (1) connected to the film remains (10) get into the bottling installations as sheets (11).

4. A method according to claim 3, wherein the capsules (1) are pressed out of the sheet (11) amid destruction of the break-off bridge locations (9), and the collar is simultaneously formed.

5. A method according to claim 4, wherein formation of the collar (51) is formed by a punch.

6. A method according to claim 1, wherein the collar is formed by flanging.

7. A method according to claim 1, wherein the collar (51) presses the capsule (1) onto the container neck (50).

8. A method according to claim 7, wherein the container (54) with the container neck (50) is led beyond a running pressing strip in a rotating manner.

9. A method according to claim 1, wherein the membrane (80) is formed of a plastic film or an aluminium film coated with plastic, and is welded onto the container neck (50).

10. A method according to claim 9, wherein parts of the membrane (80) which project beyond the edge of the container neck (50) are pressed onto the container neck (50).

11. A method according to claim 9, wherein the membrane is a coated aluminium film which comprises an embossed structure that ensures a controlled tearing of the film.

12. A method according to claim 1, wherein the closure (100) which is positionable over the capsule (1) on the container neck (50), is pressed on or screwed on, and the closure (100) presses the collar (51) onto the container neck (50).

13. A method according to claim 1, wherein the closure (100) is of plastic which is positionable over the capsule (1) onto the container neck (50) and is heated before being placed on.

14. A method according to claim 13, wherein the closure (100) is heated by a warm air blower (110).

* * * * *